United States Patent [19]

Korfanta

[11] 4,295,308

[45] Oct. 20, 1981

[54] POLE BASE ASSEMBLY, BOLT CIRCLE ADAPTOR

[75] Inventor: Carl Korfanta, Denver, Colo.

[73] Assignee: K S L Corporation, Denver, Colo.

[21] Appl. No.: 88,530

[22] Filed: Oct. 26, 1979

[51] Int. Cl.[3] ..... E04H 12/00

[52] U.S. Cl. ..... 52/296; 248/158

[58] Field of Search ..... 52/293, 295, 296, 297, 52/98; 248/158; 403/2, 338

[56] References Cited

U.S. PATENT DOCUMENTS

| | | | |
|---|---|---|---|
| 2,240,016 | 4/1941 | Pinney | 52/296 |
| 3,311,333 | 3/1967 | Galloway | 52/296 X |
| 3,552,073 | 1/1971 | Millerbernd | 248/158 |
| 3,572,223 | 3/1971 | Vierregger | 52/296 |
| 3,630,474 | 12/1971 | Minor | 52/296 X |
| 3,671,738 | 6/1972 | Beachley | 52/296 X |
| 3,837,752 | 9/1974 | Shewchuk | 52/295 X |
| 4,154,037 | 5/1979 | Anderson | 52/296 |

OTHER PUBLICATIONS

Electrical World, "Today's Design Trends", Sep. 22, 1969, p. 43.

*Primary Examiner*—J. Karl Bell

*Attorney, Agent, or Firm*—Richard D. Law; Bruce G. Klaas

[57] ABSTRACT

An adapter for the concrete foundation mounted bolts to the bolt holes of a pole base of a different configuration, including a lower plate arranged to be secured to bolts on the concrete base, an upper plate arranged to be secured to the pole base and interconnecting braces inclusive of a central electric wire passage and supporting braces between the plates.

4 Claims, 6 Drawing Figures

POLE BASE ASSEMBLY, BOLT CIRCLE ADAPTOR

This invention relates to adapters for securing poles with a base to a bolt held in a concrete foundation, where the bolt arrangement does not fit the bolt hole arrangement on the pole base.

PRIOR ART

Metal utility poles, particularly light poles, have been used for years. The great volume of vehicular traffic on the world's highways has lead to the high use of artificial lighting at areas of a hazard. The lighting, on open highways and in urban districts, is normally accomplished by placing high intensity lamps on poles a substantial distance above the ground. Inveriably, accidents involving vehicles results in collisions of some of the vehicles with the light poles. One solution for alleviating damage to the vehicles, has been the use of break away mountings for the light poles so as to not compound the vehicle damage. Poles for highways have generally conformed to a standard as to all specification. Urban areas had, also, adopted the standards as an economic advantage. Thousands and thousands of poles were used over a series of years having the set design standards. Subsequent experience has demonstrated that the poles of the particular design are not suitable for the circumstances. A new set of standards was adopted, and new installations of lighting facilities use poles of the new design standards.

The old style of light poles are mounted on a concrete foundation holding a pattern of bolts arranged to fit the base of the old style pole. Replacement of the old poles with poles of the new specifications has created problems of connection of the new design base to the existing concrete bases. One method is to replace the concrete bases, however, this is expensive and wasteful.

Several methods of securing a pole base to bolts in concrete are shown in the prior art, such as U.S. Pat. No. 3,630,474 issued Dec. 23, 1971 to Minor. This patent describes a break-away support, using four break-away connectors threaded on the bolts in a concrete base. The pole base has bolt holes which mate with the bolts in the concrete foundation.

A highed pole base is shown in U.S. Pat. No. 3,311,333 issued Mar. 28, 1967 to Galloway, where the hinged base has bolt holes that mate with bolt holes on the stationary pole support plate, which has bolt holes to mate with the bolts in a concrete foundation.

U.S. Pat. No. 4,154,037 issued May 15, 1979 to Anderson has a pole base which is separable from the pole, by sliding, and base is bolted onto the bolts in the concrete.

A wooden porch column base is shown in U.S. Pat. No. 2,240,016 issued Apr. 29, 1941 to Pinney where a wooden base has bolt holes to fit three screws in a wooden porch column base. The bolts for the base are accessible from under the porch for threading into nuts, and the bolts for the wooden column are accessible from the base.

THE INVENTION

The present invention provides an adapter for bolts in particular pattern and spacing in a concrete foundation with a pole base having a different bolt hole pattern and spacing. The adapter provides a central opening for elelctric wires and cables for the luminarie mounted on a pole. The adapter includes upper and lower plates held a short distance apart for access to nuts or bolt heads between the plates, and reinforcing spacers to securely connect the two plates together.

OBJECTS AND ADVANTAGES OF THE INVENTION

Included among the objects and advantages of the invention is to provide an adapter for the bolts on a concrete foundation with bolt holes in a pole base with a low profile permitting a standard skirt for the pole base to cover the adapter.

Another object of the invention is to provide an adapter for preset bolts to preset bolt holes in a pole base, maintaining sufficient clearance for access to bolt head or nuts in the adapter, and provide sufficient strength to resist stresses placed on the adapter.

Still another object of the invention is to provide a pole base adapter arranged with a passage for electric cables and wires and with sufficient strength to withstand the stresses placed on it by the pole.

These and other objects and advantages of the invention may be ascertained by reference to the following description and appended drawings.

GENERAL DESCRIPTION OF THE DRAWINGS

DETAILED DESCRIPTION OF THE INVENTION

The adapter of the invention includes a base plate having bolt holes for the bolt pattern set in a concrete foundation and a top plate having a bolt hole pattern for the bolt hole pattern of a pole base. The plates are rigidly secured together but spaced apart, permitting access to nuts for the bolts and providing a passage for electric cables, etc.

Figure 1:
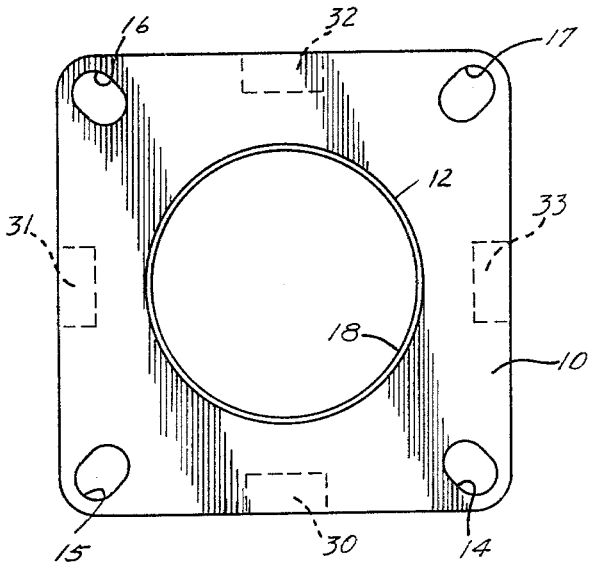
FIG. 1 is a plan view of a bolt plate for a pole base of the adapter of the invention.
Figure 2:
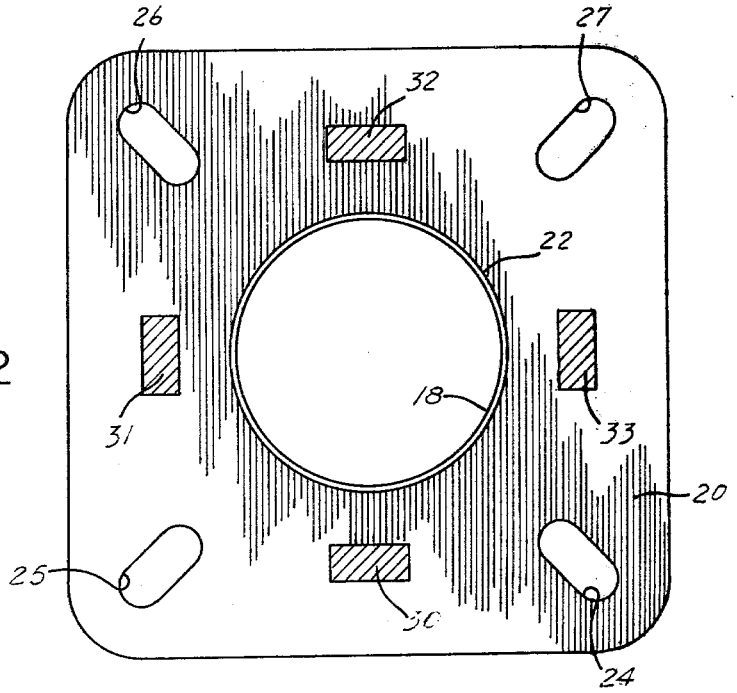
FIG. 2 is a plan view of a base plate for preset bolts, of the adapter of the invention.
Figure 3:
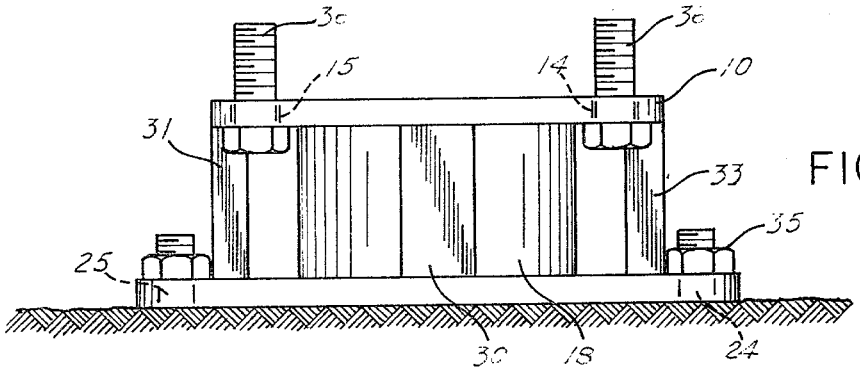
FIG. 3 is a side elevation of one form of the adapter of the invention.

One preferred modification illustrated in FIGS. 1–3, includes top plate 10 having a large central, circular aperture 12. The plate is essentially square with rounded-off corners and elongated bolt holes 14, 15, 16 and 17 adjacent the corners, and with the long dimension of the holes on radials from the center of the plate. A short length of pipe 18 is welded on both sides of the plate into the bore 12. A bottom plate 20, also, has a central circular bore 22 of the same size as bore 12, so that the length of pipe 18 may be welded on both sides of the plate into the bore. The plate 20 is generally square with rounded corners, and bolt holes 24, 25, 26 and 27 are formed in the plate. The bolt holes are elongated, with the long dimension on a radial from the center of the plate. Addition connectors 30, 31, 32 and 33 are welded to the edge of the top plate, centered on a side. These connectors are welded to the base plate at position in line with the in positions on the top plate.

The bottom plate is about 16 inches square, and the top plate is about 12 inches square, for luminaria poles.

The bolt holes in base plate are on 16" spacings on diagonals measuring from inside edge of one hole to the inside edge of the opposite hole on the diagonal. The holes in the base plate for the bolts are conveniently made 2 inches long. The plates are made of 1 inch steel stock. The top plate, of the 1 inch stock, has its bolt holes spaced 12 inches apart on diagonals with $1\frac{1}{4}$ inch long holes. The connectors are 1 inch by 2 inch by 4 inch long steel stock spacers welded to both plates. The pipe 18 is a steel pipe 7 inches I.D. with a 3/16 inch wall.

The unit is placed on a concrete foundation having bolts in a square pattern, being spaced about 16 inches apart on diagonals. The adapter is secured down by nuts 35 on the bolt ends exposed above the concrete in the foundation. Bolts placed through the holes in the top plate may be used to bolt the base of pole (not shown) to the unit. The skirt or cover for the bases of such poles are used to cover the base and bolts. The standard skirt or cover for the pole bases cover the adapters as well as the base of the pole. The central opening is large enough for the cables needed for the luminarie.

Figure 4:
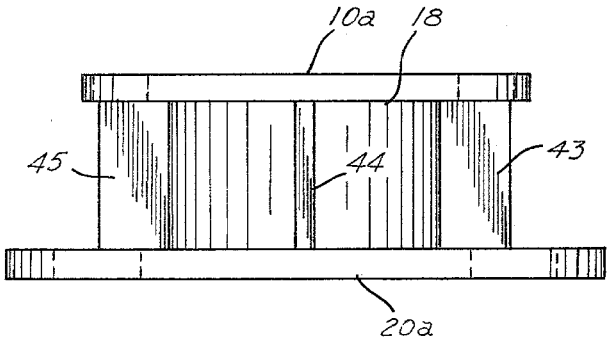
FIG. 4 is a side elevation of a modified adapter according to the invention.
Figure 5:
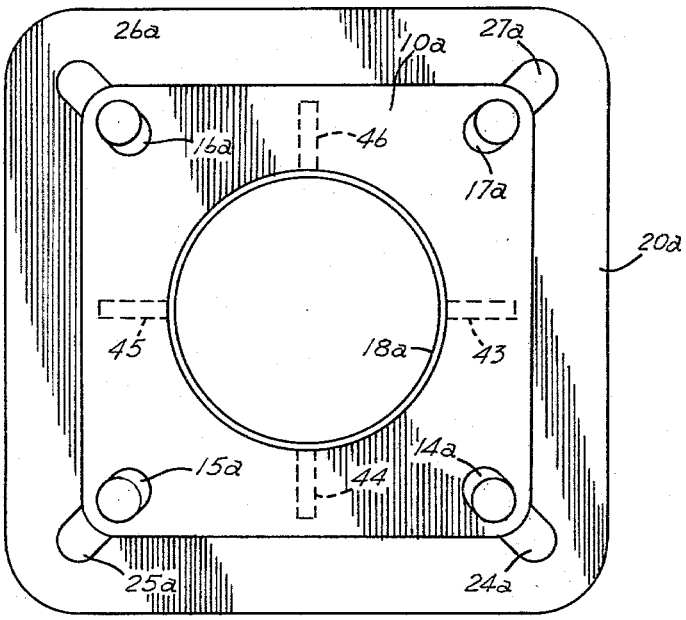
FIG. 5 is a top plan view of the assembly of one form of the adapter.
Figure 6:
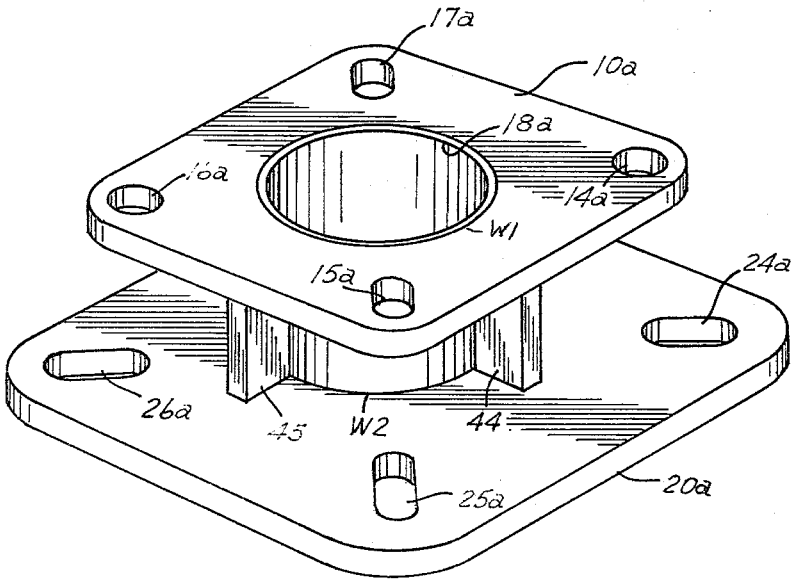
FIG. 6 is a perspective view of the assembly of FIG. 5.

The preferred unit of FIGS. 4–6 is similar to the unit of FIGS. 1–3, using a slightly different spacer system. The unit includes top plate 10*a* and bottom plate 20*a*, each having elongated bolt holes in a similar pattern, such as 14*a*, 15*a*, 16*a* and 17*a*, each for retaining a bolt therein. The base includes elongated bolt holes 24*a*, 25*a*, 26*a* and 27*a*. A central pipe 18*a* is mounted in central bores through each plate, and is welded to the plate. Support-spacers 43, 44, 45 and 46 are welded to the top and bottom plates and to the pipe.

The pipe is preferably welded at its end to the outside of the plates, at W1, FIG. 6 of the top plate, as well as the inside of the plates, as shown as at W2, FIG. 6. The spacers are preferably welded to each plate and to the pipe. This provides sufficient strength of the unit to withstand the stresses subjected on the adapter, for example, the stresses encountered when the pole is buffeted by high winds. The length of the pole induces high moment stresses on the base and the adapter. The low profile of the adapter permits it to fit within the pole base cover, without modification of the standard base covers.

What is claimed is:

1. An adapter for pole bases having a bolt hole configuration different than the bolts formed in a concrete foundation, comprising:

(a) a generally square bottom plate having elongated bolt holes set on radials from the center of said plate for mating over the bolts in a concrete foundation, and having a large central circular bore;

(b) a generally square top plate having elongate bolt holes set on radials from the center of said plate for mating with bolt holes on a pole base which are of a different configuration than the bolts on the concrete foundation, and having a central circular bore;

(c) a short length of pipe welded into the bores of said bottom and top plates to rigidly hold said plates parallel and provide space for manipulating attaching nuts and bolts, and (d) at least four spacers welded to the top and bottom plates securing the plates rigidly and strongly together and spaced a predetermined distance apart, said spacers being spaced uniformly around said short length of pipe.

2. The adapter of claim 1, wherein said spacers are mounted at the edge of the top plate.

3. The adapter of claim 1, wherein said spacers are generally rectangular, welded to the both plates and to said pipe, leaving the bolts holes clear for access by bolt tools.

4. The adapter of claim 1, wherein said bolt holes on said bottom plate are arranged to mate with bolts spaced about 16 inches apart on diagonals and set in a concrete foundation.

* * * * *